United States Patent [19]

Richardson et al.

[11] 4,211,449

[45] Jul. 8, 1980

[54] CONVERTIBLE AND COLLAPSIBLE BENCH/TABLE COMBINATION

[76] Inventors: Larry D. Richardson, 5755 Wade Rd.; Annette M. Sobolewski, 5695 S. Wade Rd., both of Coleman, Mich. 48618

[21] Appl. No.: 909,636

[22] Filed: May 26, 1978

[51] Int. Cl.[2] ..... A47B 85/04

[52] U.S. Cl. ..... 297/126; 297/173

[58] Field of Search ..... 297/117, 126, 135, 144, 297/172, 173, 174

[56] References Cited

U.S. PATENT DOCUMENTS

| | | | |
|---|---|---|---|
| 2,557,595 | 6/1951 | Bujjoni | 297/126 |
| 2,645,273 | 7/1953 | Culbertson et al. | 297/126 |
| 2,820,507 | 1/1958 | Provencher | 297/126 |
| 2,900,009 | 8/1959 | Haynes | 297/126 |
| 3,957,302 | 5/1976 | Jones | 297/126 |

FOREIGN PATENT DOCUMENTS

| | | | |
|---|---|---|---|
| 73122 | 2/1948 | Norway | 297/126 |

*Primary Examiner*—Roy D. Frazier
*Assistant Examiner*—Peter A. Aschenbrenner
*Attorney, Agent, or Firm*—N. Jerome Rudy

[57] ABSTRACT

An improved, space-saving bench/table combination assembly which is convenient, compactable and storable, as well as being exceptionally stable and steady in fully expanded disposition, comprises a bench section or portion having pivotally attached thereto a seat back component or portion adapted to be placed at least substantially upright with respect to the seat section which component folds upwardly and outwardly forward ahead of the bench section to present and position its front section in a substantially horizontal plane as a table top from which top depends at its leading or outermost extended edge fold-out legs that are retractable to storage on the back side of the seat back component providing positive and solid table support nicely effective beyond the center of gravity between the leading edge of the table and the bench section of the completely unfolded assembly when it is in such position. The seat assembly advantageously has collapsible, fold-under seat legs which render it very highly compact in completely folded-down condition; it also being excellently stackable for efficient storage in either seat-back bench form or in a completely folded down condition.

10 Claims, 12 Drawing Figures

CONVERTIBLE AND COLLAPSIBLE BENCH/TABLE COMBINATION

BACKGROUND OF THE INVENTION

There are known and more or less utilized a great number and variety of combined chair, seat or bench/table or desk constructions, some of which are to some greater or lesser extent of a collapsible nature.

By way of exemplification of this, reference may be had to U.S. Pat. Nos. 10,908 to Bass; 56,540 to Ehlman; 1,299,881 to Walter; 1,401,083 to Jurkovich; 1,218,322 to Sandell; 2,645,273 to Culbertson et al.; 2,842,185 to Fortine; 2,900,009 to Haynes; 2,931,425 to Rasco et al.; 3,361,470 to Gustin et al.; Des. 178,611 to Mickelson; Des. 181,727 to Haynes, Sr.; and Des. 182,474 to Mielke.

Several serious deficiencies and inadequacies are quite evidently inherent in the heretofore revealed and available articles and items of furniture of the indicated type and style. To particularize the more salient of these, the bulk of the more troublesome drawbacks include such things as the assemblies being: awkward with required incorporation of cumbersome and unnecessary features and parts; top-heavy, poorly-centered and unsafe from a reliably stable balance point of view; and/or not capable of very efficient and compact folding or breaking down for minimized conformation to facilitate maximized nestability for stacking and space-saving storage capability.

More specifically:

The Bass contrivance is too large and of obviously literally "huge" proportional design to be of realistic moment for modern concepts and taste acceptabilities. In addition, it is plainly not stackable. To avoid tumbling over when it is folded out, it has to be secured to a ground platform, as shown and taught in the disclosure of the patent.

The Ehlman structure must have two separately finished surfaces, distinct for back and front in the table portion, to be operable. It, too, is not of a stackable nature.

In the Walter device, the conversion results in the original seat portion becoming the table top. This unavoidably results in a miniature and inherently uncomfortable structure upon conversion.

The Jurkovich arrangement requires a backwards movement and lifting of the seat back attachment of the unit during conversion which then, for best results, must be placed in a double back-to-back relationship to provide any sort of usable bench/table result. Further, this opened-out form of arrangement is plainly one of a very "crowded" nature causing much in-and-out difficulty for personal movement in use, especially insofar as concerns user's leg movements and manipulations.

Sandell's unit, when made into combination form, gives a very bad load center characteristic, displaying in this most of the same awkward in-and-out features of Jurkovich. Furniture devised according to the Sandell concept could not be employed as a chair in a closely adjacent back-against-wall relationship since it would be unavoidably unfoldable when so stationed due to wall interference unless the entire unit were physically moved out to a spacing sufficiently far from the wall to allow for unfolding of the unit.

The Culbertson et al. appliance results in a seriously off-center, top-heavy piece when converted which is plainly greatly susceptible to being easily toppled when overloaded as a table or awkwardly leaned upon by the user sitting in the unit. This appliance is merely movable, and not at all compactable or stackable.

Fortine's relatively inflexible design requires tedious disassembly for conversion in order to reconstruct the pieces so that the underside seat can be made into a table top.

The Haynes apparatus, when converted, gives a dangerously top-heavy, off-center furniture piece that is easily upset with too great a table load. The same undesirable feature is readily evident in the Design Patents to Mickelson, Haynes, Sr. and Mielke; the same also being inherent as above noted in Sandell and Culbertson et al. and intrinsically considerably badly off-center and dangerous because of the too-easily-tippable characteristic to users, particularly active and sometimes not-cautious-or-prudent-in-movement children.

The Rasco et al. furniture is severely limited in its utility by the glaring fact that it can be made, but only in one way or the other, in the form of either a bench or a table but not both and not readily (without literally total disassembly) convertible back and forth. It is not a neat nor compact structure in either form; and requires movement of two surfaces in order to achieve form changement.

The Gustin et al. article is quite awkward and treacherous. It has subtending parts that could jab into the lower torso of one sitting therein. It also does not permit disposition of its legs so as to allow collapse on folding; and further (unless grossly uncomfortable and not-practically-supporting short seat backs are employed) yields a very awkward bench/table structure in which the table top necessarily and in ungainly, cramping style extends over the bench portion.

It would obviously be desirable to have a truly attractive and vastly improved, convenient, easily-operable and readily compactable, stackable and storeable convertible and collapsible bench/table combination item of furniture that would avoid and not be subject to the shortcomings, design inadequacies and drawbacks and other insufficiencies and dissatisfactory details and features of prior and hitherto revealed and practiced prior art.

FIELD AND OBJECTIVES OF THE INVENTION

The present invention lies generally in the furniture field, being more particularly relevant to an attractive, neat, compact, safe, solid and sound, relatively facile and uncomplicated and simple to manufacture bench/table combination adaptable to outdoor-type or indoor useages which is convenient, easily interchangeable as to utilization form, and nicely stackable and/or foldable to greatly diminished size and proportions for movement and storeage; the provision of same for furniture and equipment useage and applications being amongst the principal aims and objectives of the invention.

SUMMARY OF THE INVENTION

The instant contribution to the art is directed to an article of convertible and collapsible furniture, which is a bench/table combination comprising: a bench seat section having front, rear and side edges and under support legs depending therefrom; a changeable surface component with horizontal, opposed leading and stationary edges and side edges with front and back surfaces therebetween, which component is adapted to function as a bench seat back with its front surface facing the front edge of said bench section when upright and a table and the like top with said front surface uppermost when at least substantially horizontally disposed; a pair of hinged swing arms mounted pivotally towards the rear edge along each of the side edges of said bench section and rotatably movable about their pivot mountings in a direction frontwards and rearwards with respect to said bench section; said changeable surface components being hingedly mounted along each of its side edges and towards its stationary edge to and at pivot points on the upper extremities of both of said swing arms so that its leading edge is freely movable through an upwardly and downwardly directed arcuate movement about the center line of said pivot points; and a pair of foldable legs mounted respectively along the leading edge and towards the side edges on the back side of said changeable surface component, said legs being adapted to lie flatly in retracted storage against the back side of said component when it is disposed upright as a seat back and to be unfolded downwardly outward from the back side of said component to provide leading edge table leg support for said component when it is swung out to substantially horizontal disposition as a table and the like top.

Further salient particulars and significant specifics relevant to embodimentation of the invention are ingenuously delineated in the ensuing Specification and description.

ILLUSTRATED REPRESENTATION OF THE INVENTION

Further features and characteristics of the present contribution to the art are even more readily apparent and evident in the following Specification and description when taken in conjunction with the accompanying generally representative, overall relatively figurative and sometimes somewhat schematic Drawing, (in the several FIGURES of which and insofar as possible like reference numerals refer to and identify like parts), wherein.

Figure 6:
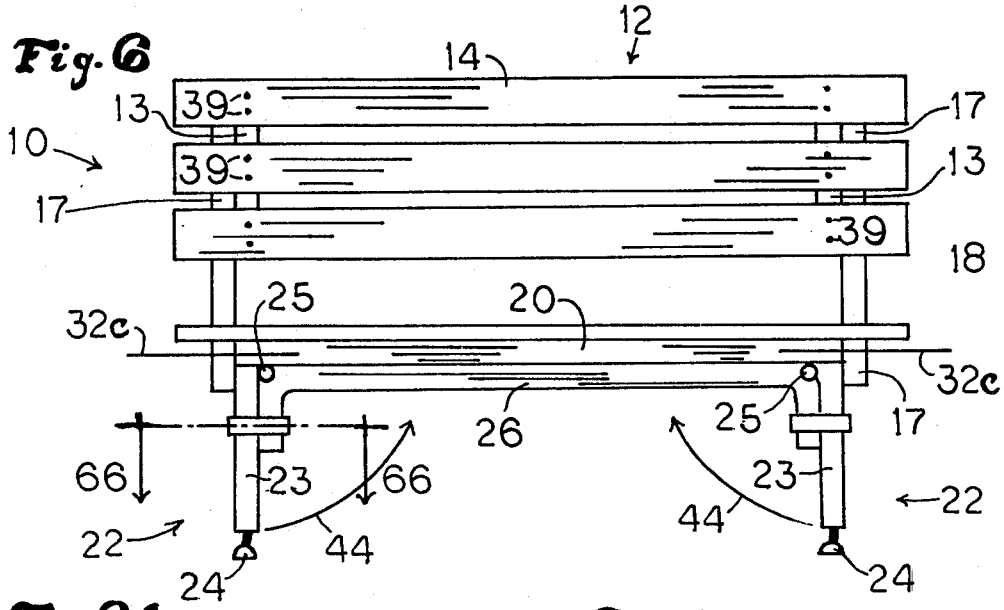
FIG. 6 is a front elevation view of a version of the combination like that illustrated in FIGS. 4 and 5 showing a beneficial reinforcing support bar or brace inclusion for steadying the legs of the seat section thereof.
Figure 6A:
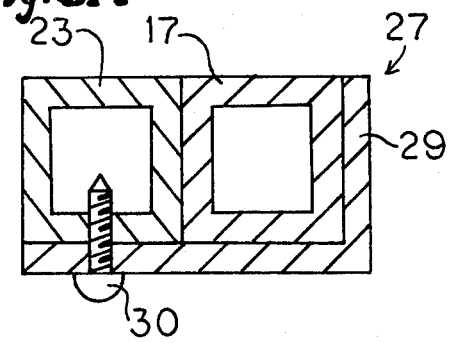
FIG. 6A is a plan view in cross-section of the leg and engaged reinforcing support bar taken along the Line 66—66 in FIG. 6 demonstrating a simple, clasping lock clamp arrangement for maintaining the associated parts in effective engagement and more steady position.
Figure 8:
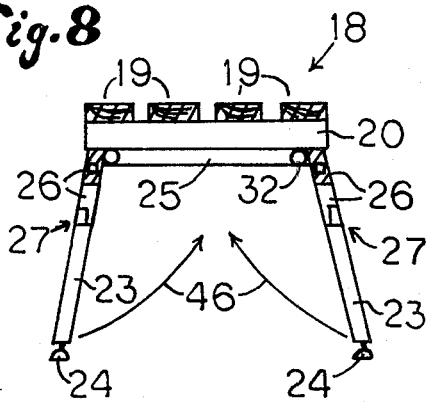
Figure 6R:
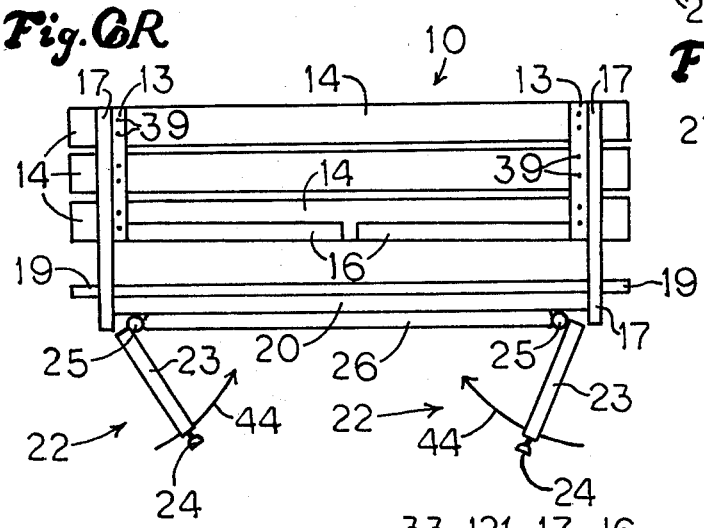
Figure 9:
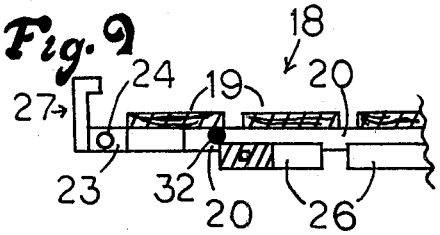
Figure 7:
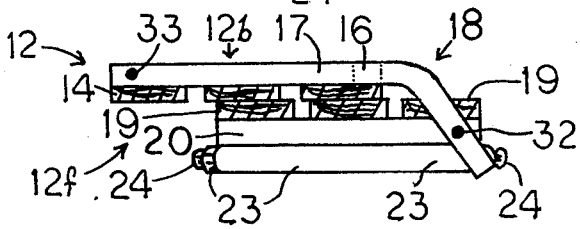

FIG. 6R is a rear view, taken as if seen from the back side of the version shown in FIG. 6, but with both of the retractable seat legs partly taken up and the reinforcing bar support folded up under the bench portion and also more clearly illustrating the position of the collapsible table top legs in folded storage behind the table top component when the same is disposed as a seat back for the bench;

FIG. 7, in side elevation, is a view of a completely folded-down and ready for movement and/or storage bench/table combination in accordance with the present invention;

FIG. 8 is a partial view in side elevation that is sectional, as if the unit were intermediately severed along the seat so as to show only and no more than the depending, folded-down legs of the seat section in downwardly extending situation in cooperative, interengaged and interlocked relationship with cooperating reinforcing support bars (illustrated partly in section at the imaginary cut-off point along the seal); and FIG. 9 is a side elevation view of the seat section part of a combination according to the invention which is depicted in a way analogous to that of FIG. 8, with the legs and reinforcing bars retracted and folded-up for storage under the seat of the bench.

PARTICULARIZED DESCRIPTION OF THE INVENTION

Figure 1:
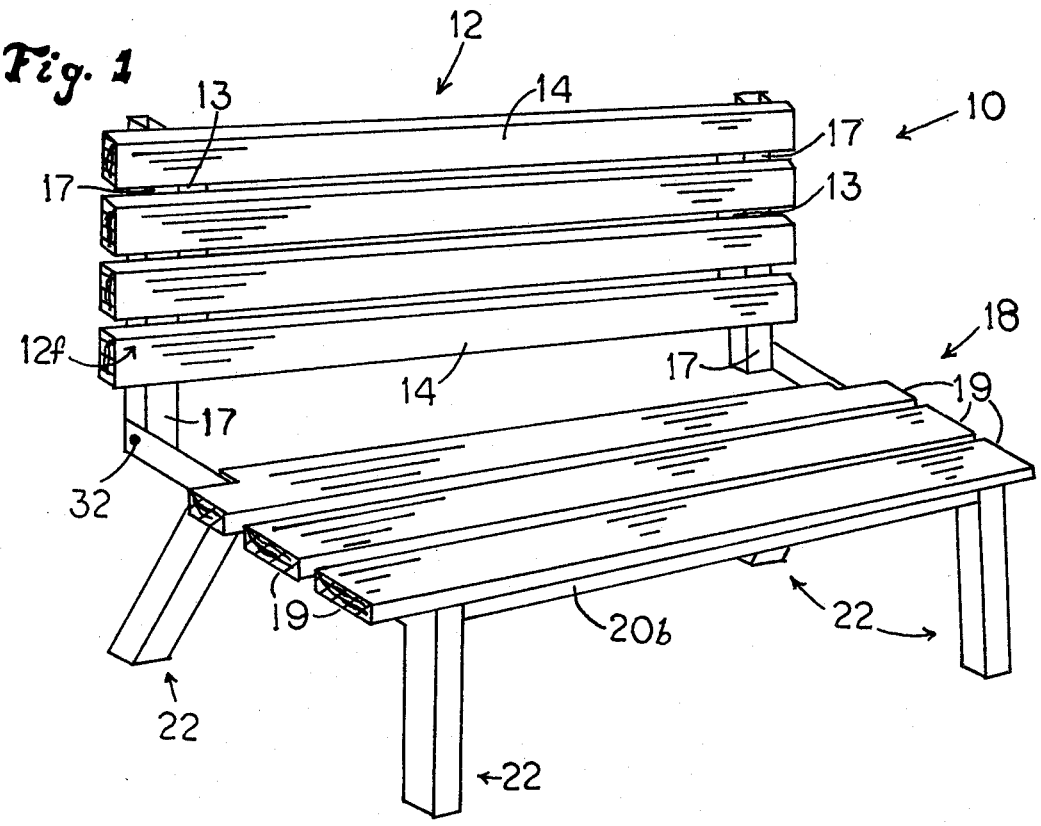
FIGS. 1 and 2 are simplified perspective views (with FIG. 2 being a partly broken-away showing) of one embodied form of the invention in, respectively, bench and table forms.
Figure 2:
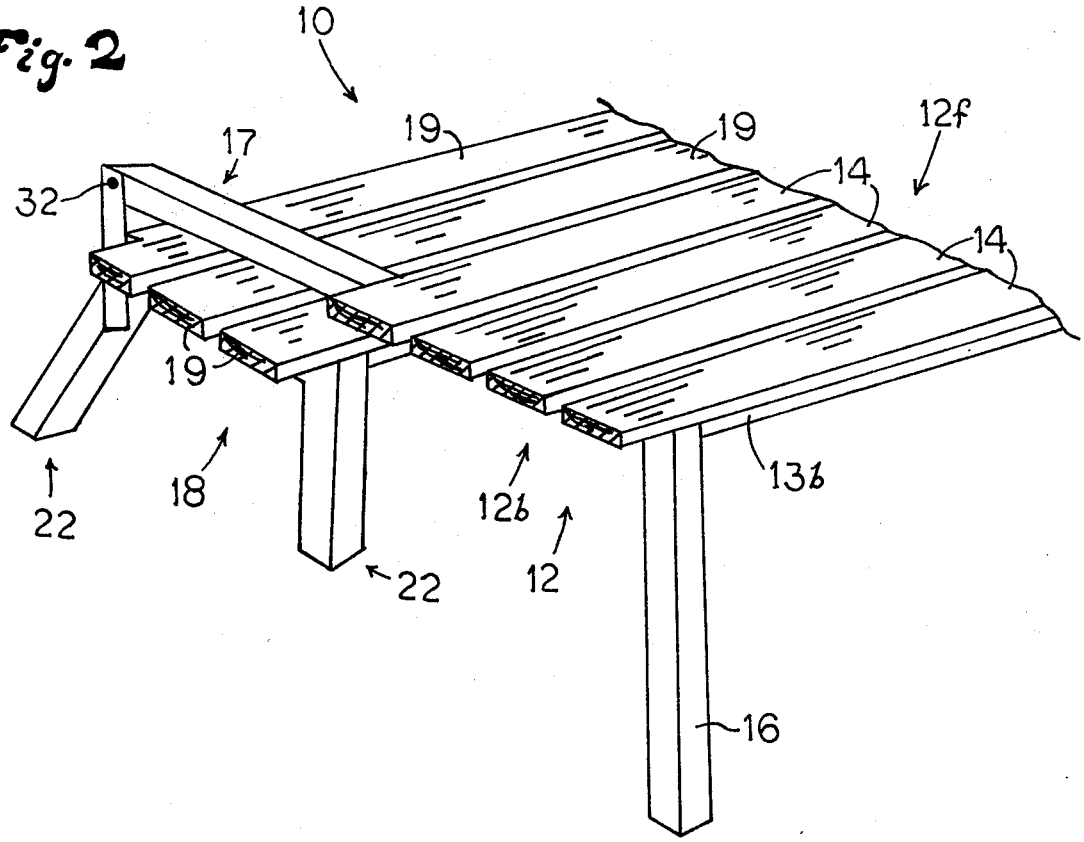
Figure 3:
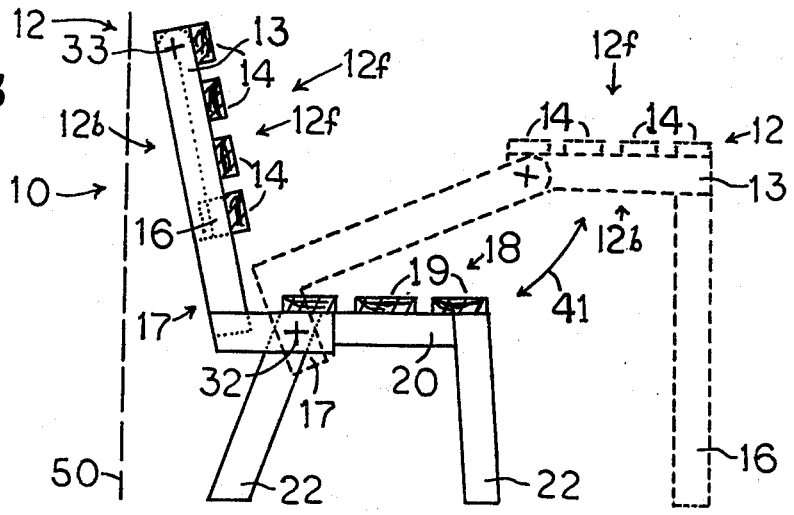
FIG. 3 is a side elevation view of a slightly varied construction of the embodiment shown in FIGS. 1 and 2 illustrating, respectively, the bench form in solid outline and the table form in phantom outline.

For purposes of further illustration and to show in a relatively elementary demonstrative fashion one style of embodiment of the present bench/table combination, primary (albeit not exclusive) reference is first had to FIGS. 1–3, inclusive, of the Drawing.

A convertible and collapsible bench/table combination basically pursuant to the present invention is generally identified by reference numeral 10. Extending upwardly in a more or less vertical and upright manner is the seat back component or portion of the combination, generally identified by reference numeral 12. The exact angular disposition of back component portion 12 is made so as to provide a graceful and comfortable, leanback support or rest position for a person sitting on the bench when the combination is so erected. Usually and for this reason, the back portion 12 is arranged to have a slight, backwardly-disposed angulation from the vertical to conform to a most desirable and easy sitting posture.

Back component portion 12 has a front side **12*f* (as considered or taken when it is in an upright position for the sitter to lean against when the combination 10 is erected as a bench unit) and an opposite rear or back side 12*b*. It is, of course, the front side 12*f* which, as is hereinafter more fully explained, serves as a table or desk top when combination 12** is unfolded and completely extended to its table position or configuration.

Thus, component 12 is in effect a changeable surface component. As below explained, it has an arcuately movable leading edge and an at least comparatively stationary edge opposite the leading edge which stationary edge is either uppermost when the component is disposed and employed as a bench seat back and/or innermost when the component is in table disposition.

The embodiment shown has a plurality of slats or boards 14 extending laterally therein to comprise the actual seat back. These are mounted hingedly at their top through and so as to swingably or arcuately move about pivot mounting 33 on a pair of separately movable support post extensions 13 by any suitable fastening means such as screws, nails, bolts, clamps and so forth (designated figuratively by reference numeral 39 in FIG. 6). Alternatively, if desired, glues, adhesives or weldments can be employed for the purpose. Each support post extension 13 is part of and movably fastened to and at or near the upper extremity of the pivotal swing arm unit, generally identified as number 17, through the pivot mounting 33. In addition, lateral support braces **13*b* on rear side 12*b* of the seat (as seen in FIG. 2) may be employed if desired to help support the structure, especially in conjunction with the table legs (identified by reference numeral 16). The swing arm 17 is rotatably secured to the frame of the seat component of the combination by means of schematically identified pivot mountings 32, incorporated so that the seat back portion or changeable surface component 12 is swingable or movable backwards and forwards about pivot mounting 32, and likewise concentrically about the pivot center line 32*c* (identified in FIG. 6**).

Incidentally and for simplified schematic representational purposes in the several FIGURES of the Drawing in which they are indicated, the hinges or pivot mountings 31 and 32 are depicted by either solid dots (•) or crosses (+).

In this connection, bench/table combinations in accordance with the present invention can literally be prepared with about any desired material of construction and to have appearances, particular shapes and configurations of parts (such as other than strictly rectangular and/or flat bench sections and back components) and general or other features of practically any desired construction and style mode or semblance. Thus, they can have a more or less rustic, outdoor or picnic-style make-up and construction of the sort especially well adapted for outside use and as is herein predominantly illustrated in the Drawing; being thus comprised of assembled spaced boards or slats for back and seat portions. These may be of wood (including weather-resisting varieties), metal, plastic, particle board, laminate structures (such as plywood and the like or equivalent) and so forth. In many cases, even though not necessarily so if otherwise opted to employ different suitable materials for the purpose, it is obviously advantageous for the frame and support elements of the construction to be wooden framing or solid metal sections or, as is often preferred, channel, hollow or tubular construction metal including steel, aluminum, magnesium and so forth. Either or both of the seat and back sections 12 and 18 may be solid, if preferred. And, analogously if so wanted, they may be made in any desired fashion style, as in the form of padded, pillowed or upholstered furniture and so forth.

Foldable inwardly for storage when the combination 10 is in bench configuration are a pair of legs 16. These are not specifically depicted in FIG. 1 in their retracted against-the-seat-back, storage disposition (although as FIGS. 3 and 6R bring out there is no difficulty in comprehension of them in such placement). In any event, the legs 16 are generally disposed along the upper edge on the rear side **12*b* of seat back portion 12. So, when slat back portion 12 is swung out in unfolding manner to form a table or desk arrangement, the legs 16 can be manipulated downwardly to be lowered to an upright posture for the then-arranged positive table top support. This, as mentioned, is more particularly drawn out in the view of FIG. 6R in the accompanying Drawing. The legs 16 are usually secured by swing hinges (not shown) so as to be foldable inwards to lay flat along seat back portion 12**. They may advantageously have lock clamp supports (of the type commonly found on foldable card table legs and the like) to better secure them in place when in an unfolded, down and table-supporting position.

The bench section or seat back and table-forming portion in and of the combination 10, which is generally identified by reference numeral 18, has at least a pair of underframe or support braces 20, preferably running from back to front along each edge thereof. Of course, one or more intermediate braces 20 can also be provided or other sorts of underframing can be utilized. When a solid seat portion 18 is involved it may be suitable to dispense with underseat structural support members. The actual seat is formed of a plurality (of any desired number) of slat boards 19 secured by any suitable means to underframe elements 20. Lateral reinforcing member(s) **20*f*, as appear in FIG. 1, can also be utilized for additional underseat support. As is the case with the seat back portion, any desired means of fastening can be utilized for securing seat members 19 to underframe 20**.

The seat legs, generally identified by reference numeral 22, depend in any desired way from beneath the seat. While they may be fixed and rigid, it is oftentimes desirable (as hereinafter more fully explained) to have legs 22 foldable and retractable up under seat portion 18 (as particularly drawn out in FIGS. 6A, 7 and 8) to allow for utmost compactability of a completely folded-down combination bench/table unit according to the invention. This readily allows for most compact handling and storage ease and efficiency in the combination 10. When seat legs 22 are fixed and rigid, it is usually advantageous to have at least the rear set of them outwardly inclined so as to lend features of easy nestability or stackability to the combination. Although not pictured in the Drawing, a stacked plurality of bench/table combinations composed preferably in bench form for nesting purposes is readily visualizable. In this way, satisfactory and space-saving storage possibilities are made inherent and readily available in the unit.

In operation then, any bench/table combination according to the present invention is readily converted from bench (or seat) to table (or desk) form by merely pulling or moving the changeable surface component or seat back portion 12 forwardly; then simultaneously or sequentially unfolding same (in a motion indicated by directional arrow 41 in FIG. 30 so that the front side **12*f* is converted, as it were, to form the actual table or desk top. This is supported in position by the downward unfolding of the legs 16. The table conformation of combination 10 is depicted in phantom outline in FIG. 3 of the Drawing. As noted, such an availability and placement (at and down from the front edge of convertable seat back/table top portion 12) provides excellent and complete stability to and optimum load-supporting capability in the combination when it is completely extended and adjusted to its table configuration. The legs 16 positively and in a substantially non-upsettable or -tiltable manner positively support the table arrangement, regardless of table top loading. This is by virtue of the fact, as is particularly evident in FIGS. 2, 3 and 5, that support of the completely unfolded table top by legs 16 is provided beyond the center of gravity of the table form between the forward edge of the bench or seat portion 18** of the combination and the outermost edge of the table surface; thus, as has been emphasized, rendering it literally not at all prone to topple over frontwards regardless of table or desk top loading.

This feature and intrinsic characteristic of the bench/table combination of the present invention lends a most desirable safety feature to the unit. This is particularly valuable when the combination is employed for heavy duty usage and/or especially when children are involved; the reasons for same being obvious when taking the mentioned substantially non-tipping property of the table configuration of the combination into account.

Of course, a single unit of the combination, when unfolded to table configuration, provides a single bench/table construction. Full tables with face-to-face seating can, if desired, be simply made by placing two units in front-table-edge joining abutment.

As is further evident from the foregoing description and the Drawing, especially in respect of FIGS. 1–5 thereof, the combination can be easily used as a bench backed up to and closely stationed against a wall (schematically depicted by dashed line 50 in FIG. 3) that is immediately converted to table form without any necessity to lift and/or move the entire assembly away from the wall for conversion purposes.

Going predominantly now to FIGS. 4–7, 5A, 6A and 6R, inclusive, of the Drawing, there is therein seen another version of a bench/table combination 10 pursuant to the present invention. This, as it appears, is generally quite analogous to the embodiment portrayed in FIGS. 1–3 but also and additionally embodies some advancive components and features that thereto lend even greater compactability when fully collapsed—and enhanced sturdiness when erected.

The combination delineated in FIGS. 4–7 is made to have fold-under legs 23 swingably mounted under the outer side edges of the slat portion 18 by means of a hinge member 25 operating in attachment between the legs 23 and support braces 20. The legs 23, which incline slightly outwardly from each side of the bench, can be inwardly folded up under seat portion 18 in the directional manner indicated by the arrows 44 (in FIG. 6). Feet elements or gliders 24 are often desirable to include at the bottom extremities of legs 23 for actual ground contact and to facilitate sliding movement of an erected assembly.

To help secure and steady the legs 23 when they are downwardly extended for maintaining the bench in upright erect position there is provided at least one retractable or swingable reinforcing support brace 26. Each brace 26 is placed along the front or back edge (or both of the edges when double bracing is utilized) of seat portion 18 and maintained there by any pivotable support fixed between the movable brace 26 and the underside of the seat portion, such as the hinge means 52*a* and 52*b* which are figuratively respectively shown by means of an open circle (o) in FIG. 8 and a solid dot (•) in FIG. 9 in place in FIGS. 8 and 9. When swung down, the brace 26 abuts the inner and upper side of each of the legs 23 to keep them secure in the downthrust position and, besides this, to resist against possible wobbling or sway effects of the erected bench.

In order to keep the reinforcing brace 26 in good and effective engagement with legs 23, it is advantageous to utilize some sort of clamping or locking means to keep the separate members respectively fixed together when in their put-down or lowered positions. One simple and direct way to achieve this is by means of a clamp unit 27 as illustrated in FIG. 6A (and also apparent in FIGS. 8 and 9), although many other suitable and equivalent locking arrangements can be utilized as will be understood by those skilled in the art. In any event, clamp unit 27 is merely an L-shaped bracket arm 29 fastened in any suitable way, such as screw means 30, one leg 23 so as to be extendable over and about reinforcing brace 25 in a hooking disposition thereabout with leg and bracket down. This is easily done during erection of the bench/table combination by first extending the legs 23 to lowering in their upright disposition then dropping the brace 26 into place adjoining the legs at each of its sides within the receptacle of the bracket arm 29 of clamp unit 27.

It is generally helpful and contributory to stability in the types of bench/table combinations set forth in the Drawing for the pivotable swing arm members 17 on which the seat back portion 12 is movably mounted to have a means for stopping it in either the bench or table configurations. This can be a simple stop means 21, as is designated in FIGS. 4 and 5 and more fully illustrated in FIG. 5A. Stop means 21 can be a simple pin or projection 21*p* extending inwardly from the lower end of at least one, and preferably both, of the swing arms 17.

Figure 4:
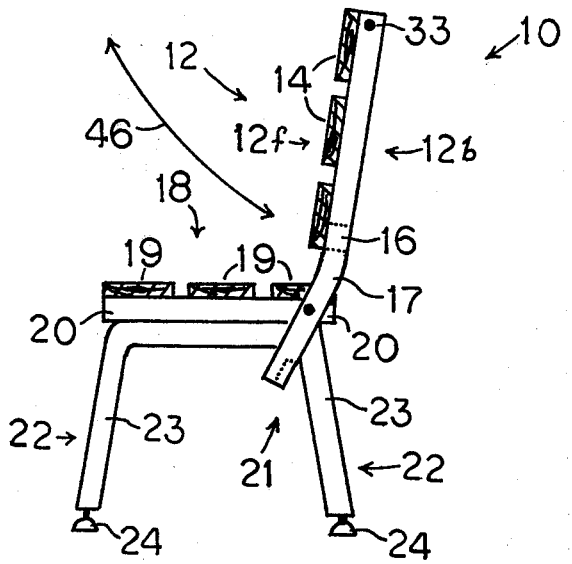
FIGS. 4 and 5 are side elevation views of a somewhat differently designed embodiment of the invention having additional advantageous components and features showing, respectively, the version in bench and table configurations.

The pin 21*p* is so situated on the swing arm as to be urged and pressed upwardly against the upper bottom side portion(s) of leg(s) 23 when the seat back portion 12 is in its upright bench-forming position, as is particularly shown in FIG. 4. This keeps the portion 18 in desired more or less upright situation when it is used as a seat back. In this connection, it is possible to have the stop pin 21*p* movably fastenable along the lower part of swing arm 17 to facilitate, when the pin is located farther from the end of the swing arm, a greater angulation of backward-slanting recline in the seat back.

Figure 5:
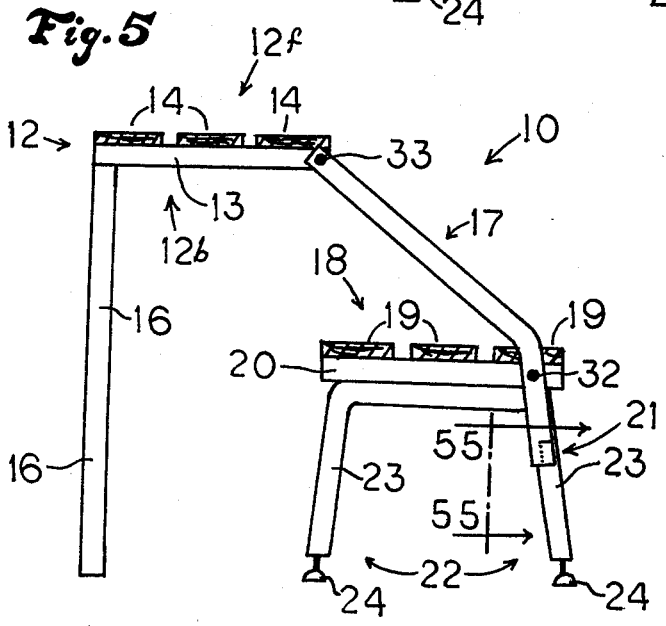
Figure 5A:
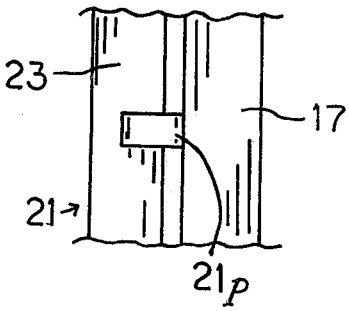
FIG. 5A is a broken-away front elevation view of the leg and swing arm parts of the combination taken along the Line 55—55 in FIG. 5 to particularly illustrate a simple stop arrangement for keeping the combination in desired configuration.

When combination 10 is in table configuration with swing arm 17 thrust and underslung outwardly to permit outward rotation of seat back portion 12 to provide the table top on front side 12*f*, the pin 21*p* is stopped against the inner edge(s) of the rear leg(s) 23, as is particularly shown in FIG. 5 (with stop means 21 adjusted in that position as it is specifically viewed in FIG. 5A). This maintains the inner edge of portion 12 at a desired elevation so that the table top is maintained level or at any desired degree of pitch or slant if an inclined desk top or other surface is wanted. Again, a relocatable pin 21*p* in swing arm 17 can advantageously allow adjustment, if desired, in the table work top angulation by simple movement of the fixed position of the stop pin on the swing arm.

The representation of FIG. 6R is already evident and drawn out in and from the foregoing and needs no further explanatory ramifications, it essentially more directly illustrating the retracted and, as it were, withdrawn and "snapped back" postures of the movable support members of the combination; these, namely, being table top support legs 16, bench support legs 23 and reinforcing braces 26 for legs 23.

FIGS. 8 and 9, (with FIG. 9 obviously complementing FIG. 6R) as indicated, illustrate the bench portion of a combination. Leg(s) 23 and reinforcing brackets 26 are opened down and in engagement for erect bench support in FIG. 8. In FIG. 9, clearly demonstrating how compact a unit with foldable legs can be, the leg 23 shown and brackets 26 are retracted upwardly (in the direction of arrow 46) under for storage flatly against the underside of the seat portion 18. Of course, although shown as to be so hinged as to be swingable upwards and inwards when folded for storage, the brackets 26 can swing, individually or in combination, outwardly from the bench section if so desired.

FIG. 7 pictures a collapsible bench/table combination pursuant to the invention and of the type brought forth in FIGS. 4–7 of the Drawing in completely broken down and compacted form. The advantageous capability of easily handling and storing such reduced units in any desired way (such as one-on-top-another or vertically side-by-side) is clearly evident in and comprehensible from this demonstration.

Many changes and modifications can readily be made and adapted in embodiments in accordance with the present invention without substantially departing from its apparent and intended spirt and scope, all in pursuance and accordance with same as it is set forth and defined in the hereto appended Claims.

What is claimed is:

1. As an article of convertible and collapsible furniture, which is a bench/table combination comprising:

a bench seat section having front, rear and side edges and under support legs depending therefrom;

a changeable surface component with horizontal, opposed longitudinal edges, one of which depending on assembled position of the said article is an inward or upward pivotally secured edge with the other being an arcuately movable edge and also on said component side edges connecting said longitudinal edges with front and back surfaces on said component between all of said edges which component is adapted to function as a bench seat back with its front surface facing the front edge of said bench section when upright and a table and the like top with said front surface uppermost when at least substantially horizontally disposed;

a pair of hinged swing arms mounted pivotally towards the rear edge along each of the side edges of said bench section and rotatably movable about their pivot mountings in a direction frontwards and rearwards with respect to said bench section;

said changeable surface component being hingedly mounted along each of its side edges towards its inward or upward, depending on positioning, longitudinal edge to and at pivot ponts on the upper extremities of both of said swing arms so that its arcuately-movable longitudinal edge is freely movable through an upwardly and downwardly directed arcuate movement about the center line of said pivot points; and a pair of foldable legs mounted respectively along the arcuately-movable longitudinal edge and towards the side edges on the back side of said changeable surface component, said legs being adapted to lie flatly in retracted storage against the back side of said component when it is disposed upright as a seat back and to be unfolded downwardly outwardly from the back side of said component to provide leading edge table leg support for said component when it is swung out to substantially horizontal disposition as a table and the like top.

2. As an article of convertible and collapsible furniture, a bench/table combination comprising:

an at least substantially flat and horizontally disposed bench section;

collapsible supporting legs fastened under and depending from said bench section;

a pair of spaced movable swing arms pivotally mounted towards their lower extremities along each end side edge and towards the rearward edge of said bench section, said arms projecting upwardly and movable in their major extensions from their pivot points above the top of the bench section;

an at least apparently flat seat back and table-forming changeable surface component having a front, at least substantially planar side to sit against when said component is disposed more or less upright and a back side, said component being hingedly mounted towards each of its uppermost horizontal edges when upright and sides with and almost if not between the swing arms along a pivot center line towards the outermost extremities of said swing arms so that the lowermost longitudinal leading edge of said component is free to rotate about said pivot center line along which the component is hingedly mounted;

said component being adapted with forward movement of said swing arms to be rotatably folded outwardly and upwardly about the said pivot center line along which it is hingedly mounted so as to level it and dispose same to provide its front side as a table top extended in a more or less horizontal plane with said front side up;

a pair of legs foldably mounted on the back side of said component towards the corners at its lowermost edge, said foldable legs adapted to be folded flat for storage along the back side of said component when same is in a more or less upright seat back-providing disposition and being further adapted to be swung down and lowered to a vertically upright disposition when said component is folded out to extended disposition providing a table top with said legs thereupon supporting the table configuration of said configuration under and about at its outermost extended edge.

3. The furniture combination of claim 2, wherein said collapsible supporting legs for the bench section are adapted to be retracted and folded upwardly for storage under and up against the bottom of said bench section.

4. The furniture combination of claim 2, and containing, in addition thereto and in combination therewith, at least one reinforcing bracket hingedly secured so as to be movably extendable downwardly from said bench section and storable flatly under and up against the bottom of said bench section when moved upwardly, each reinforcing bracket placed longitudinally along the underside of said bench section and being adapted when extended downwardly to engage the respective inner sides of at least one pair of longitudinally opposed collapsible legs when the legs are disposed downwardly in suppport position for said bench section so as to reinforce and prevent collapse or wobbling of said legs when said bench section is in an erect position.

5. The furniture combination of claim 4, and containing, in addition thereto and in combination therewith, lock means for securely clamping together said legs and said cooperating reinforcing bracket(s) when both are in downwardly extended, mutually engaging disposition.

6. The furniture combination of claim 2, and containing, in addition thereto and in combination therewith, stop means at the lower extremities of at least one of said movable swing arms beneath its pivotable mounting point along the bench section side edge, which stop means are adapted to arrest and adjust the backward tilting location of said changeable surface component when it is in upright seat back position and to further adjust and support the longitudinal edge of said component that is inwardly opposite the leading edge thereof when the component is horizontally disposed as a table top.

7. The furniture combination of claim 2, and containing, in addition thereto and in combination therewith, at least one reinforcing bracket hingedly secured so as to be movably extendable downwardly from said bench section and storable flatly under and up against the bottom of said bench section when moved upwardly, each reinforcing bracket placed longitudinally along the underside of said bench section and being adapted when extended downwardly to engage the respective inner sides of at least one pair of longitudinally opposed collapsible legs when the legs are disposed downwardly in support position for said bench section so as to reinforce and prevent collapse or wobbling of said legs when said bench section is in an erect position; and lock means for securely clamping together said legs and said cooperating reinforcing bracket(s) when both are in downwardly extended, mutually engaging disposition.

8. The furniture combination of claim 7, and containing, in further addition thereto and in combination therewith, stop means at the lower extremities of at least one of said movable swing arms beneath its pivotable mounting point along the bench section side edge, which stop means are adapted to arrest and adjust the backward tilting location of said changeable surface component when it is in upright seat back position and to further adjust and support the longitudinal edge of said component that is inwardly opposite the leading edge thereof when the component is horizontally disposed as a table top.

9. The furniture combination of claim 2, wherein said bench section and said changeable surface component are each of a wooden material of construction.

10. The furniture combination of claim 2, wherein said bench section and said changeable surface component are each of a wooden material of construction in the form of pluralities of weather-resisting, longitudinally-extending slat boards, said combination having a rustic and picnic-style appearance and semblance and being adapted to outdoor utilization.

* * * * *